US010260123B2

(12) United States Patent
Takada et al.

(10) Patent No.: US 10,260,123 B2
(45) **Date of Patent: *Apr. 16, 2019**

(54) ROLLED STEEL BAR FOR MACHINE STRUCTURAL USE AND METHOD OF PRODUCING THE SAME

(71) Applicant: NIPPON STEEL & SUMITOMO METAL CORPORATION, Tokyo (JP)

(72) Inventors: Hiromasa Takada, Chiba (JP); Shinya Teramoto, Hokkaido (JP); Osamu Ohyama, Hokkaido (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 146 days.

This patent is subject to a terminal disclaimer.

(21) Appl. No.: 15/322,360

(22) PCT Filed: Jul. 3, 2015

(86) PCT No.: PCT/JP2015/069289

§ 371 (c)(1),
(2) Date: Dec. 27, 2016

(87) PCT Pub. No.: WO2016/002935

PCT Pub. Date: Jan. 7, 2016

(65) Prior Publication Data

US 2017/0137904 A1 May 18, 2017

(30) Foreign Application Priority Data

Jul. 3, 2014 (JP) ..... 2014-137736

(51) Int. Cl.

| | |
|---|---|
| ***C21D 9/00*** | (2006.01) |
| ***B21B 1/16*** | (2006.01) |
| ***B22D 11/00*** | (2006.01) |
| ***C21D 7/13*** | (2006.01) |
| ***C21D 8/00*** | (2006.01) |
| ***C21D 8/02*** | (2006.01) |
| ***C21D 8/06*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/24*** | (2006.01) |

(Continued)

(52) U.S. Cl.

CPC ..... *C21D 9/0081* (2013.01); *B21B 1/16* (2013.01); *B22D 11/001* (2013.01); *C21D 7/13* (2013.01); *C21D 8/005* (2013.01); *C21D 8/0226* (2013.01); *C21D 8/06* (2013.01); *C21D 8/065* (2013.01); *C22C 33/04* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/24* (2013.01); *C22C 38/28* (2013.01); *C22C 38/60* (2013.01); *C21D 2211/005* (2013.01)

(58) Field of Classification Search

CPC ..... B22D 11/001; B23K 7/008; B23K 7/06; C21D 8/005; C21D 8/06; C21D 8/065; C21D 9/0081; C22C 38/00; C22C 38/001; C22C 38/002; C22C 38/02; C22C 38/04; C22C 38/06; C22C 38/24; C22C 38/28; C22C 38/60; B21B 1/16

See application file for complete search history.

(56) References Cited

U.S. PATENT DOCUMENTS 3,846,186 A * 11/1974 Tipnis et al. ..... C22C 38/60 148/325
9,574,255 B2 * 2/2017 Higashida ..... C21D 8/06

(Continued)

FOREIGN PATENT DOCUMENTS

CN 1169992 C 10/2004
CN 101410541 A 4/2009

(Continued)

OTHER PUBLICATIONS

International Search Report for PCT/JP2015/069289 dated Sep. 29, 2015.
Written Opinion of the International Searching Authority for PCT/JP2015/069289 dated Sep. 29, 2015.
Chinese Office Action and Search Report for corresponding Chinese Application No. 201580035172.5, dated Nov. 1, 2017, including an English translation of the Chinese Search Report.
Chinese Office Action and Search Report for Chinese Application No. 201580034599.3, dated Nov. 29, 2017, with partial English translation.
International Search Report (Form PCT/ISA/210) for International Application No. PCT/JP2015/069272, dated Oct. 6, 2015, with English translation.

(Continued)

*Primary Examiner* — Cam N. Nguyen
(74) *Attorney, Agent, or Firm* — Birch, Stewart, Kolasch & Birch, LLP

(57) ABSTRACT

A rolled steel bar for machine structural use includes a predetermined chemical composition comprising, by mass %, C: 0.45% to 0.65%, Si: higher than 1.00% to 1.50%, Mn: higher than 0.40% to 1.00%, P: 0.005% to 0.050%, S: 0.020% to 0.100%, V: 0.08% to 0.20%, Ti: 0% to 0.050%; Ca: 0% to 0.0030%, Zr: 0% to 0.0030%, Te: 0% to 0.0030%, and a remainder including Fe and impurities, wherein the impurities include: Cr: 0.10% or lower, Al: lower than 0.01%, and N: 0.0060% or lower. In the rolled steel bar for machine structural use, K1 obtained from "K1=C+Si/7+Mn/5+1.54×V" is 0.95 to 1.05, K2 obtained from "K2=139−28.6×Si+105×Mn−833×S−13420×N" is more than 35, K3 obtained from "K3=137×C−44.0×Si" is 10.7 or more, a Mn content and a S content satisfy Mn/S≥8.0, and a total decarburized depth in a surface layer is 500 μm or less.

4 Claims, No Drawings

(51) Int. Cl.
*C22C 38/28* (2006.01)
*C22C 38/60* (2006.01)

(56) References Cited

U.S. PATENT DOCUMENTS

| | | | | |
|---|---|---|---|---|
| 9,951,403 | B2 * | 4/2018 | Matsui | C21D 8/06 |
| 9,994,943 | B2 * | 6/2018 | Matsui | C21D 8/06 |
| 2006/0196583 | A1 * | 9/2006 | Hayashi | C22C 38/02 148/330 |
| 2007/0000582 | A1 * | 1/2007 | Matsuzaki | C22C 38/02 148/575 |
| 2007/0163687 | A1 * | 7/2007 | Kurosawa | C21D 9/30 148/566 |
| 2008/0247900 | A1 * | 10/2008 | Hayashi | C21D 1/10 420/84 |
| 2015/0034049 | A1 * | 2/2015 | Matsui | C21D 8/06 123/456 |
| 2015/0125339 | A1 * | 5/2015 | Imataka | C21D 8/06 420/91 |
| 2015/0218685 | A1 | 8/2015 | Teramoto et al. | |
| 2017/0067140 | A1 * | 3/2017 | Aiso | C22C 38/60 |
| 2018/0057917 | A1 * | 3/2018 | Matsui | C21D 8/06 |

FOREIGN PATENT DOCUMENTS

| | | | |
|---|---|---|---|
| CN | 102985577 | A | 3/2013 |
| EP | 1312689 | A1 | 5/2003 |
| JP | 59-177352 | A | 10/1984 |
| JP | 5-306432 | A | 11/1993 |
| JP | 7-3386 | A | 1/1995 |
| JP | 9-143610 | A | 6/1997 |
| JP | 10-226847 | A | 8/1998 |
| JP | 11-152542 | A | 6/1999 |
| JP | 2000-256741 | A | 9/2000 |
| JP | 2004-60046 | A | 2/2004 |
| JP | 2004-60049 | A | 2/2004 |
| JP | 2004-346415 | A | 12/2004 |
| JP | 2009-228051 | A | 10/2009 |
| JP | 2013-107127 | A | 6/2013 |
| JP | 5522321 | B1 | 6/2014 |
| KR | 10-2009-0071163 | A | 7/2009 |

OTHER PUBLICATIONS

Japanese Notice of Allowance for Japanese Application No. 2016-531473, dated Aug. 29, 2017, with English translation.

U.S. Office Action for U.S. Appl. No. 15/322,251, dated Aug. 6, 2018.

Written Opinion of the International Searching Authority (Form PCT/ISA/237) for International Application No. PCT/JP2015/069272, dated Oct. 6, 2015.

* cited by examiner

ROLLED STEEL BAR FOR MACHINE STRUCTURAL USE AND METHOD OF PRODUCING THE SAME

TECHNICAL FIELD OF THE INVENTION

The present invention relates to a rolled steel bar for machine structural use which is suitable as a material of a mechanical component or a structural member (hereinafter, referred to as "mechanical structural member") produced by hot forging or the like, and a method of producing the same.

Priority is claimed on Japanese Patent Application No. 2014-137736, filed on Jul. 3, 2014, the content of which is incorporated herein by reference.

RELATED ART

In a mechanical structural member used in a vehicle, an industrial machine, or the like, not only high strength but also excellent ductility and toughness may be required. In this case, it is preferable that a metallographic structure of the mechanical structural member is tempered martensite. Therefore, in many cases, the mechanical structural member is formed by performing a refining heat treatment such as quenching and tempering and machining hot forged a steel bar which is a material of the mechanical structural member.

On the other hand, in a mechanical structural member in which high toughness or ductility are not necessary, in general, machining is performed after hot forging without performing a refining heat treatment from the viewpoint of production costs. In a case where a metallographic structure of steel (non-heattreated steel), which is produced without performing a refining heat treatment, is a composite structure including ferrite and pearlite, excellent machinability and a high yield ratio are obtained. In a case where the metallographic structure includes bainite, the machinability deteriorates, and the yield ratio decreases. Therefore, in many cases, a metallographic structure of rolled or normalized steel is a composite structure including ferrite and pearlite.

In addition, fatigue resistance may be required for a mechanical structural member.

In this case, a mechanical structural member having a metallographic structure, which is a composite structure including ferrite and pearlite, has a problem in that soft ferrite causes fatigue fracture. In order to solve the problem, for example, Patent Documents 1 to 3 disclose steel or a hot-forged product in which fatigue resistance is improved by hardening ferrite and reducing the difference in hardness between ferrite and pearlite due to solid solution strengthening by addition of Si and precipitation strengthening by addition of V or the like.

However, in Patent Document 1, it is necessary that steel contain more than 0.30% of V. In a case where the steel contains a large amount of V, even if the heating temperature during hot forging is sufficiently high, V is not sufficiently solid-soluted. In this case, undissolved V carbide remains, which causes a problem in that the strength and ductility of the mechanical structural member deteriorate.

In addition, in Patent Document 2, it is necessary that steel contains 0.01% or higher of Al. However, Al has a problem in that Al forms a hard oxide in the steel that significantly deteriorates the machinability thereof.

In addition, in Patent Document 3, it is necessary that steel contains 1.0% or higher of Mn and 0.20% or higher of Cr. However, Mn and Cr have a problem in that they promote bainite transformation and thereby deteriorating machinability and decreasing the yield ratio.

On the other hand, for example, Patent Document 4 discloses a steel in which fatigue resistance (fatigue strength) is improved by solid solution strengthening using Si instead of V, which is an expensive element and due to refinement of lamellar spacing by addition of Cr.

However, in a case where steel contains a certain amount or less of Si, fatigue resistance can be improved. However, in a case where steel contains a large amount of Si, there is a problem in that a decarburized layer is formed on a surface of steel and the fatigue resistance of the steel as a mechanical structural member deteriorates. In addition, in Patent Document 4, it is necessary that steel contains 0.10% or higher of Cr. However, Cr promotes bainite transformation and thereby deteriorating machinability and decreasing the yield ratio.

PRIOR ART DOCUMENT

Patent Document

[Patent Document 1] Japanese Unexamined Patent Application, First Publication No. H7-3386

[Patent Document 2] Japanese Unexamined Patent Application, First Publication No. H9-143610

[Patent Document 3] Japanese Unexamined Patent Application, First Publication No. H 11-152542

[Patent Document 4] Japanese Unexamined Patent Application, First Publication No. H10-226847

DISCLOSURE OF THE INVENTION

Problems to be Solved by the Invention

As described above, in the related art, a mechanical structural member having excellent fatigue resistance, which contains a large amount of Si without containing Cr and Al to reduce the costs, has not been provided.

The present inventors performed a thorough investigation and found that, in order to improve the fatigue resistance of a mechanical structural member, in particular, it is important to control the hardness of a surface of the mechanical structural member. In addition, the present inventors found that, in order to control the hardness of a surface of a mechanical structural member, it is effective to control a structure of a surface part of a rolled steel bar (rolled steel bar for machine structural use) which is a material of the mechanical structural member.

The present invention has been made in consideration of the above-described circumstances, and an object thereof is to provide a rolled steel bar for machine structural use which is suitable as a material of a mechanical structural member in which high strength and excellent fatigue resistance are required, and a method of producing the same.

Means for Solving the Problem

As described above, in order to improve the fatigue resistance of a mechanical structural member, it is important to control the hardness of, in particular, a surface of the mechanical structural member. To that end, it is effective to control a structure of a surface part of a rolled steel bar (rolled steel bar for machine structural use) which is a material of the mechanical structural member.

However, it was found that, in a case where a rolled steel bar, which contains a large amount of Si without containing Cr to reduce cost, is used as a material of a mechanical structural member, decarburization of a surface of the mechanical structural member is significant, the hardness decreases, and the fatigue resistance deteriorates.

Therefore, the present inventors investigated the effect of decarburization on fatigue resistance and the reason for decarburization in a mechanical structural member which is formed of a rolled steel bar containing a large amount of Si. As a result, the present inventors discovered that the decarburization of a surface of the mechanical structural member occurs due to the rolled steel bars which are the material of the mechanical structural member.

Further, the present inventors clarified that decarburization of a surface of a rolled steel bar is derived from decarburization of a cast piece which is promoted in a temperature range of an $\alpha/\gamma$ dual phase region in which ferrite ($\alpha$) and austenite ($\gamma$) are present together during cooling after continuous casting or during heating before hot rolling, and investigated countermeasures. The present inventors clarified that, by increasing the C content in the steel to reduce the temperature range of an $\alpha/\gamma$ dual phase region (a temperature difference between the $A_3$ temperature and the $A_1$ temperature) in which decarburization is promoted and reducing the size of a cast piece during casting, a period of time during which the temperature of the cast piece is in the $\alpha/\gamma$ dual phase region is reduced and the decarburization of a surface of a rolled steel bar can be reduced. In addition, it was also found that, by reducing the size of the billet, a blooming step for adjusting the size of a billet after casting can be removed.

Further, the present inventors discovered an optimum component composition (chemical composition) and production conditions of a rolled steel bar with which the strength of a mechanical structural member, which is formed by hot-forging the rolled steel bar, can be improved while securing the hot ductility of the rolled steel bar which requires during hot forging.

In addition, the present inventors also discovered that excellent fatigue resistance (fatigue limit ratio) can be obtained in the mechanical structural member which is obtained by hot-forging the rolled steel bar.

The present invention has been made based on the above-described findings. The summary of the present invention is as follows.

(1) According to a first aspect of the present invention, a rolled steel bar for machine structural use having a chemical composition including, by mass %, C: 0.45% to 0.65%, Si: higher than 1.00% to 1.50%, Mn: higher than 0.40% to 1.00%, P: 0.005% to 0.050%, S: 0.020% to 0.100%, V: 0.08% to 0.20%, Ti: 0% to 0.050%, Ca: 0% to 0.0030%, Zr: 0% to 0.0030%, Te: 0% to 0.0030%, and a remainder including Fe and impurities, in which the impurities include Cr: 0.10% or lower, Al: lower than 0.01%, and N: 0.0060% or less, K1 obtained from the following Expression 1 is 0.95 to 1.05, K2 obtained from the following Expression 2 is more than 35, K3 obtained from the following Expression 3 is 10.7 or more, the Mn content and the S content satisfy the following Expression 4, and a total decarburized depth in surface layer is 500 μm or less, $$K1=C+Si/7+Mn/5+1.54\times V \quad \text{(Expression 1)},$$

$$K2=139-28.6\times Si+105\times Mn-833\times S-13420\times N \quad \text{(Expression 2)},$$

$$K3=137\times C-44.0\times Si \quad \text{(Expression 3), and}$$

$$Mn/S\geq 8.0 \quad \text{(Expression 4)}$$

C, Si, Mn, V, S, and N in Expressions 1 to 4 represent the contents of the respective elements by mass %.

(2) The rolled steel bar for machine structural use according to (1), wherein the chemical composition may further include, by mass %, one or more selected from the group consisting of Ti: 0.010% to 0.050%, Ca: 0.0005% to 0.0030%, Zr: 0.0005% to 0.0030%, and Te: 0.0005% to 0.0030%.

(3) According to another aspect of the present invention, a method of producing a rolled steel bar for machine structural use, the rolled steel bar for machine structural use being the rolled steel bar for machine structural use according to (1) to (2) includes: making molten steel having the chemical composition according to (1) or (2); continuously casting the molten steel to obtain a cast piece having a cross-sectional area of 40000 $cm^2$ or less; and subsequently to the continuous casting, heating the cast piece to a temperature range of 1000° C. to 1150° C. and holding the cast piece in the temperature range for 7000 seconds or shorter and performing a steel bar rolling.

Effects of the Invention

In the rolled steel bar for machine structural use according to the aspects of the present invention in which the Cr content and the Al content are limited and which includes a large amount of Si to reduce the costs, the formation of a deep decarburized layer can be prevented. A mechanical structural member which is produced by hot-forging the rolled steel bar has excellent fatigue resistance and thus remarkably contributes to the industry. In addition, under the production conditions according to the aspects of the present invention, a blooming step can be removed from the production steps of the rolled steel bar. Therefore, the production costs can be reduced, and the contribution to the industry is extremely significant.

Embodiment of the Invention

A rolled steel bar for machine structural use according to an embodiment of the present invention (hereinafter, also referred to as "rolled steel bar according to the embodiment") has a chemical composition including, by mass %, C: 0.45% to 0.65%, Si: higher than 1.00% to 1.50%, Mn: higher than 0.40% to 1.00%, P: 0.005% to 0.050%, S: 0.020% to 0.100%, V: 0.08% to 0.20%, and a remainder including Fe and impurities, and optionally further includes Ti: 0.050% or lower, Ca: 0.0030% or lower, Zr: 0.0030% or lower, and Te: 0.0030% or lower. In the rolled steel bar for machine structural use, the impurities includes Cr: 0.10% or lower, Al: lower than 0.01%, and N: 0.0060% or lower, K1 obtained from "K1=C+Si/7+Mn/5+1.54×V" is 0.95 to 1.05, K2 obtained from "K2=139−28.6×Si+105×Mn−833×S−13420×N" is more than 35, K3 obtained from "K3=137×C−44.0×Si" is 10.7 or more, the Mn content and the S content satisfy Mn/S≥8.0, and the total decarburized depth in surface layer is 500 μm or less.

First, the chemical composition of the rolled steel bar according to the embodiment will be described. Hereinafter, "%" regarding the chemical composition represents "mass %". In a case where content is expressed by a range in the following description, the range includes an upper limit and a lower limit. That is, in a case where content is expressed by a range of 0.45% to 0.65%, for example, the range represents 0.45% or higher and 0.65% or lower.

(C: 0.45% to 0.65%)

C is an element which can increase the tensile strength of the steel at low cost. In addition, C is an element and decreases the $A_3$ temperature of the steel. Decarburization of a surface of a cast piece is promoted when the temperature of the cast piece is in an $\alpha/\gamma$ dual phase region (that is, a temperature range of the $A_3$ temperature to the $A_1$ temperature) during cooling after continuous cooling or during heating before hot rolling. Therefore, decarburization of the surface of the cast piece is reduced by increasing the C content, and thereby narrows the temperature range of the $\alpha/\gamma$ dual phase region.

In the rolled steel bar according to the embodiment, the C content is set to be 0.45% or higher in order to narrow the temperature range of the $\alpha/\gamma$ dual phase region and to thereby secure the strength. On the other hand, in a case where the rolled steel bar according to the embodiment is continuously cast immediately after being formed by hot forging, the higher the C content in the steel, the lower the yield ratio. The yield ratio is a value obtained by dividing a 0.2% proof stress by a tensile strength. When the yield ratio decreases, in a case where the 0.2% proof stress is a predetermined value, the tensile strength increases excessively, which causes deterioration in machinability. Accordingly, the C content is set to be 0.65% or less in order to prevent a decrease in the yield ratio of the mechanical structural member. The C content is preferably 0.60% or lower.

(Si: Higher than 1.00% to 1.50%)

Si is an element that is inexpensive and is effective for contributing to high-strengthening of the steel. In order to obtain the effect, the Si content is set to be higher than 1.00%. The Si content is preferably 1.10% or higher. On the other hand, in a case where the Si content is excessively high, the decarburized depth of surface layer is excessively large, hot ductility deteriorates, defects are likely to occur during steel bar rolling or hot forging. As the Si content increases, the temperature range of the $\alpha/\gamma$ dual phase region become broader. Therefore, the Si content is set to be 1.50% or lower.

(Mn: Higher than 0.40% to 1.00%)

Mn is a solid solution strengthening element that can increase the strength of the steel while preventing a decrease in ductility as compared to Si and V. In addition, Mn is an element that is bonded to S to form MnS and to thereby improve machinability. When the Mn content is low, S forms FeS at an austenite grain boundary and deteriorates hot ductility. Therefore, cracks or defects are likely to be initiated. Accordingly, in order to prevent the formation of FeS and to secure hot ductility, the Mn content is higher than 0.40%. On the other hand, in a case where the Mn content is excessively high, bainite that decreases the yield ratio may also be present in a structure of a hot-forged product. Therefore, the Mn content is set to be 1.00% or lower. The Mn content is preferably 0.95% or lower and is more preferably 0.90% or lower.

(P: 0.005% to 0.050%)

P is an element that promotes ferrite transformation to prevent bainite transformation. In order to prevent bainite transformation during cooling after hot forging, the P content is set to be 0.005% or higher. On the other hand, in a case where the P content is excessively high, hot ductility deteriorates, and defects may be initiated in the billet. Therefore, the upper limit of the P content is limited to 0.050%. The P content is preferably 0.040% or lower.

(S: 0.020% to 0.100%)

S is an element that forms manganese sulfide (MnS) to improve machinability, and contributes to improvement of machinability. In order to obtain the effect, the S content is set to be 0.020% or higher. On the other hand, in a case where the S content is higher than 0.100%, a large amount of coarse MnS is dispersed in the steel, hot ductility deteriorates, and defects may be initiated in the billet. Therefore, the upper limit of the S content is limited to 0.100%.

(V: 0.08% to 0.20%)

V is an element that forms V carbide and/or V nitride to contribute to precipitation strengthening of the steel, and has an effect of increasing the yield ratio of the steel. In order to obtain the effect, the V content is set to be 0.08% or higher. On the other hand, V is an expensive alloy element and promotes undesirable bainite transformation during cooling after hot forging. Accordingly, in order to reduce the costs and to prevent bainite transformation, the V content is set to be 0.20% or lower. The V content is preferably 0.15% or lower.

The rolled steel bar according to the embodiment has the above-described chemical composition and contains a remainder including Fe and impurities. However, the rolled steel bar according to the embodiment optionally further includes Ca, Te, Zr, and Ti in the following ranges instead of a portion of Fe. However, since it is not necessary that the rolled steel bar includes these elements, the lower limits thereof are 0%.

Here, the impurities refer to elements that are incorporated from raw materials such as ore or scrap, or incorporated in various environments of the production process when the steel is industrially produced, and the impurities are allowed to be included in the steel in a range where there are no adverse effects in the present invention. The amounts of, in particular, Al, N, and Cr among the impurities, are limited to the following ranges.

(Al: Lower than 0.01%)

Al is an impurity. In a case where Al is present in the steel, Al is bonded to oxygen to form hard Al oxide and to thereby deteriorate the machinability of the steel. Accordingly, the lower the Al content, the better. In a case where the Al content is 0.01% or higher, the machinability deteriorates significantly. Therefore, the Al content is limited to lower than 0.01%.

(N: 0.0060% or lower)

N is an impurity. In a case where N is present in the steel, N is bonded to V to form V nitride. The V nitride is coarser than V carbide and has a small contribution to precipitation strengthening as compared to V carbide. Accordingly, as the N content increases, the amount of V nitride increases, and the amount of V carbide decreases accordingly. As a result, the contribution of V to precipitation strengthening decreases. In order to obtain the effect of sufficient precipitation strengthening even in a case where the V content is low, it is preferable that the total amount of V nitride is small. Therefore, it is preferable that the N content is low. In a case where the N content is higher than 0.0060%, in particular, the contribution of V to precipitation strengthening decreases significantly. Therefore, the N content is limited to 0.0060% or lower. On the other hand, in a case where the amount of N is reduced, the costs increase due to steelmaking technical reasons. Therefore, the lower limit of the N content may be set as 0.0020%.

(Cr: 0.10% or lower)

Cr is an impurity. Cr has little effect on the strength but promotes bainite transformation during cooling after hot forging. Therefore, in a case where the Cr content increases, the yield ratio of a mechanical structural member obtained by hot-forging the rolled steel bar decreases. The lower the Cr content, the better. In a case where the Cr content is higher than 0.10%, the effect thereof is significant. Therefore, the Cr content is limited to 0.10% or lower.

(Ca: 0.0005% to 0.0030%)

(Zr: 0.0005% to 0.0030%)

(Te: 0.0005% to 0.0030%)

Ca, Te, and Zr are elements that refine and spheroidize MnS particles (that is, control the form of a sulfide). In a case where MnS is stretched, the anisotropy of hot ductility increases. Therefore, cracks are likely to occur in a specific direction. In a case where it is necessary to control the initiation of cracks, the steel may contain one or more selected from Ca, Zr, and Te. In order to obtain the effect of refining and spheroidizing MnS, it is preferable that each of the Ca content, the Zr content, and/or the Te content is 0.0005% or higher. On the other hand, in a case where the Ca content, the Zr content, or the Te content is excessively high, a coarse oxide of Ca, Zr, or Te is formed, and thus the machinability deteriorates. Therefore, even in a case where the steel contains Ca, Zr, or Te, it is preferable that each of the Ca content, the Zr content, and the Te content is 0.0030% or lower.

Ti: 0.010% to 0.050%

Ti is an element that forms Ti nitride in the steel. Ti nitride has an effect of refining grains of the structure of the steel. In order to obtain this effect, it is preferable that the Ti content be 0.010% or higher. On the other hand, Ti nitride is hard, which may decrease the tool life during cutting. Therefore, in a case where the steel contains Ti, the Ti content is set to be 0.050% or lower.

In the rolled steel bar according to the embodiment, it is necessary that not only the amounts of the above-described respective elements but also the amounts of C, Si, Mn, V, S, and N satisfy the following relationships. In the following expressions, C, Si, Mn, V, S, and N represent the amounts of the respective elements in mass %.

(K1: 0.95 to 1.05)

K1 is a carbon equivalent that is an index indicating the strength and is obtained from the following (Expression 1).

$$K1=C+Si/7+Mn/5+1.54\times V \quad \text{(Expression 1)}$$

The tensile strength of a mechanical structural member that is formed by hot-forging the rolled steel bar according to the embodiment is affected by the carbon equivalent K1. In a case where a mechanical structural member is produced by hot-forging a rolled steel bar having a K1 value of 0.95 or more, a structure of the mechanical structural member includes pearlite, which is a major component, and ferrite, and the mechanical structural member has a tensile strength of higher than 900 MPa, a 0.2% proof stress of 570 MPa or higher, and a fatigue limit ratio (fatigue limit/tensile strength) of 0.45 or higher. On the other hand, in a case where K1 is higher than 1.05, bainite is formed in the mechanical structural member, which decreases the yield ratio. Accordingly, the carbon equivalent K1 is limited to 0.95 to 1.05.

(K2>35)

K2 is an index indicating hot ductility that is obtained from an experiment described below by the present inventors, and is obtained from the following (Expression 2).

$$K2=139-28.6\times Si+105\times Mn-833\times S-13420\times N \quad \text{(Expression 2)}$$

In the experiment, 17 rolled steel bars, which contained 0.52% to 0.54% of C and were different from each other in the amounts of Si, Mn, P, S, and N, were used. The hot ductility of a test piece having a diameter of 10 mm and a length of 100 mm, which was obtained by cutting and processing each of the rolled steel bars, was evaluated. The hot ductility was evaluated based on values of reduction in area after breaking which was obtained using a method including: heating and melting the center of the test piece; holding the test piece at various temperatures immediately after the test piece was solidified; and drawing the test piece at a rate of 0.05 mm/s to break the test piece. Regression computation was performed by using the values of reduction in area at the holding temperatures (tensile temperatures) of 950° C., 1100° C., and 1200° C. as dependent variables and using the amounts of the alloy elements as independent variables, and significant independent variables were averaged to obtain K2 (Expression 2).

As a result, in a case where this K2 value is more than 35, defects or cracks do not occur during the casting of the billet and the hot forging of the rolled steel bar. Accordingly, the hot ductility index K2 is set to be more than 35.

The upper limit of K2 is not necessarily limited and is determined based on the ranges of the respective amounts of Si, Mn, S, and N. For example, the upper limit of K2 may be set as 100.

As can be seen from Expression 2, Si, S, and N are factors that deteriorate hot ductility, and Mn is a factor that improves hot ductility. Therefore, basically, it is necessary that the K2 value is satisfied in consideration a balance between the above factors. However, as described below, in a case where Mn/S is lower than 8.0, harmful FeS is formed. Even if the K2 value is more than 35, in a case where Mn/S is lower than 8.0, the characteristics deteriorate.

(K3≥10.7)

K3 is an index indicating the width of the temperature range of the α/γ dual phase region affecting the surface decarburization, and is obtained from the following (Expression 3).

$$K3=137\times C-44.0\times Si \quad \text{(Expression 3)}$$

By adjusting K3 to be 10.7 or higher in the steel composition of the rolled steel bar according to the embodiment, the temperature range of the α/γ dual phase region can be narrowed, for example, 80° C. or lower. In this case, the decarburization occurring on the surface of the cast piece during cooling after continuous casting or during heating before hot rolling can be reduced. As a result, the decarburization of the surface of the rolled steel bar is reduced, and deterioration in the fatigue resistance of the mechanical structural member obtained after hot-forging can be prevented. From the viewpoint of reducing the decarburization, it is preferable that the temperature range of the α/γ dual phase region is narrow. Therefore, it is not necessary to set the upper limit of the K3. However, in a case where the K3 value is high and the temperature range of the α/γ dual phase region is narrow, the structure after hot forging consists of only pearlite, and the yield ratio may decrease. Therefore, the upper limit of K3 may be set as 60.

(Mn/S≥8.0)

As described above, S is bonded to Mn to form MnS. However, in a case where the S content is excessively high with respect to the Mn content, not only MnS but also FeS are formed at an austenite grain boundary. As a result, in this case, hot ductility deteriorates significantly, and cracks occur during hot forging. Accordingly, in order to prevent the formation of FeS, Mn/S is set to be 8.0 or higher. In a case where Mn/S is 8.0 or higher, the above-described K2 value is controlled by hot ductility. Accordingly, Mn/S is not particularly limited as long as it is 8.0 or higher, and the upper limit thereof is determined based on the minimum value of the S content and the maximum value of the Mn content.

Next, the decarburized depth and the structure of the rolled steel bar according to the embodiment will be described.

[Total Decarburized Depth in Surface Layer]

As described above, the decarburized depth of the rolled steel bar (total decarburized depth in surface layer) affects the fatigue resistance of a mechanical structural member obtained by hot-forging the rolled steel bar. In a mechanical structural member that is formed by hot-forging a rolled steel bar having a total decarburized depth in surface layer of more than 500 μm, the fatigue resistance (fatigue limit ratio) deteriorates. As the total decarburized depth in surface layer increases, tensile strength, proof stress, and fatigue limit ratio may decrease due to decarburization depending on steel components. Accordingly, the total decarburized depth in surface layer of the rolled steel bar is set to be 500 μm or lower. The lower limit is 0 μm (that is, a decarburized layer may not be present).

In the embodiment, the total decarburized depth in surface layer of the rolled steel bar is defined as the average value of decarburized depths in surface layer measured at 12 positions in total when decarburized depths are measured at four positions at an angle interval of 90 degrees in a circumferential direction of each of three cross-sections, the three cross-sections being obtained by cutting the rolled steel bar at the center thereof in a longitudinal direction and at two positions at a length of ¼ of the total length from two opposite ends thereof The decarburized depth of surface layer is defined as the depth at which the carbon content measured at a straight line moving to the inside from the surface is 90% or higher of the constant carbon content measured at the inside (internal carbon content), and can be measured using an electron probe micro analyzer (EPMA).

It is not necessary to limit the structure (metallographic structure) of the rolled steel bar according to the embodiment. However, as described above, it is preferable that the mechanical structural member has a composite structure (ferrite-pearlite structure) including ferrite and pearlite. In a case where the structure of the mechanical structural member is a structure including ferrite and pearlite, the structure of the rolled steel bar is also a structure including ferrite and pearlite in many cases.

Next, an example of a method of producing the rolled steel bar according to the embodiment will be described.

The rolled steel bar according to the embodiment is produced using a method including: making molten steel having the above-described chemical composition using an ordinary method (molten steel making step); continuously casting the molten steel to obtain a cast piece having a cross-sectional area of 40000 $cm^2$ or less (casting step); and hot-rolling (also referred to as steel bar rolling) the cast piece obtained by casting (steel bar rolling step). In the method of producing the rolled steel bar according to the embodiment, the casting cross-sectional area of the cast piece is sufficiently small at 40000 $cm^2$ or less. Therefore, blooming for reducing the cross-sectional area is not performed before the steel bar rolling.

As the casting cross-sectional area during the continuous casting is small, a period of time during which the temperature of the cast piece is in the $\alpha/\gamma$ dual phase region is reduced, and the surface decarburization is prevented. The present inventors performed an investigation and found that: in a case where the steel having the above-described chemical composition was cast to have a cross-sectional area of 196000 $cm^2$, the decarburized depth of surface layer was 1.8 mm at a maximum; however, in a case where the steel having the above-described chemical composition was cast to have a cross-sectional area of 40000 $cm^2$, the decarburized depth of surface layer was 0.7 mm at a maximum. In addition, in a case where the cross-sectional area was 40000 $cm^2$ during casting, the decarburized depth of surface layer was not more than 500 μm in a rolled steel bar having a diameter of 70 mm which was produced by hot-rolling the cast piece under conditions described below without blooming. As described above, in a case where the decarburized depth of surface layer of a rolled steel bar is 500 μm or less, a hot-forged product (mechanical structural member) produced by hot-forging the rolled steel bar has a small decrease in fatigue strength caused by surface decarburization. Accordingly, it is preferable that the casting cross-sectional area in the casting step is limited to 40000 $cm^2$ or less. In a case where the casting cross-sectional area exceeds 40000 $cm^2$, it is difficult to perform the steel bar rolling without blooming. During the casting, conditions other than the casting cross-sectional area may be the same as those of an ordinary method.

In the steel bar rolling (hot rolling) step, in order to promote solid solution of V into the steel, it is necessary to heat the billet to 1000° C. or higher and to perform hot rolling. By dissolving V to be solid-soluted during the heating of the steel bar rolling, the size of V carbide that reprecipitates in the rolled steel bar after hot rolling is small. As a result, during heating for hot-forging the rolled steel bar, the solid solution of V carbide is easy, and the amount of undissolved V carbide that causes a decrease in the strength and ductility of the mechanical structural member is reduced. In a case where the heating temperature is lower than 1000° C., V is not sufficiently solid-soluted. On the other hand, it is necessary that the upper limit of the heating temperature during the steel bar rolling is set as 1150° C. The reason for this is that, in a case where the billet is heated to a temperature of higher than 1150° C., the rate of surface decarburization increases rapidly. In addition, in a case where the holding time at the heating temperature increases, the decarburization is promoted. Accordingly, in order to reduce the total decarburized depth in surface layer of the rolled steel bar to 500 μm or less, the holding time at the heating temperature (1000° C. to 1150° C.) is set to be 7000 seconds or shorter. In order to sufficiently solid-solute V, it is preferable that the holding time is set to be 10 seconds or longer.

According to the production method including the above-described steps, the rolled steel bar according to the embodiment can be obtained. In addition, by forging the rolled steel bar, a structural member having excellent fatigue resistance can be obtained. Forging conditions may be the same as conditions under which a rolled steel bar is usually forged. For example, the rolled steel bar is forged at 1000° C. to 1300° C. In a case where a mechanical structural member is formed by forging, a material of the mechanical structural member is hot-forged after high-frequency heating in many cases. Since the high-frequency heating, the heating time for the temperature to reach a predetermined value is short, extreme decarburization is less likely to occur on the surface layer of the material (rolled steel bar).

EXAMPLES

Example 1

By continuous casting Steel A having a chemical composition shown in Table 1, plural cast pieces having a cross-sectional area of 26244 $cm^2$ (cross-section size: 162×162 mm), a cross-sectional area of 40000 $cm^2$ (cross-section size: 200×200 mm), or a cross-sectional area of 75000 $cm^2$ (cross-section size: 250×300 mm) were obtained. Steel A includes C and Si such that the K3 value is near the lower limit. In this composition, decarburization is likely to occur. The remainder of Table 1 includes Fe and impurities.

As shown in Table 2, these cast pieces were heated to 1150° C. or 1200° C., were held at this temperature for 7000 seconds or 10000 seconds, and then were hot-rolled to produce rolled steel bars having a diameter of 70 mm. Then, these rolled steel bars were air-cooled at room temperature. The total decarburized depths in surface layer of the rolled steel bars were obtained using the above-described method.

Table 2 shows the results of measuring the cross-sectional areas of the cast pieces and the total decarburized depths in surface layer of the rolled steel bars.

TABLE 1

| Steel | Component (mass %) C | Si | Mn | P | S | V | Cr | Al | N | Mn/S | K1 | K2 | K3 |
|---|---|---|---|---|---|---|---|---|---|---|---|---|---|
| A | 0.48 | 1.25 | 0.62 | 0.017 | 0.051 | 0.11 | 0.07 | 0.006 | 0.0055 | 12.2 | 0.95 | 52 | 10.8 |

TABLE 2

| | Casting | Steel Bar Rolling | | Total Decarburized | |
|---|---|---|---|---|---|
| No. | Cross-Sectional Area $cm^2$ | Heating Temperature ° C. | Holding Time sec | Depth in Surface Layer of Rolled Steel Bar μm | Note |
| A1 | 26244 | 1150 | 7000 | 177 | Example |
| A2 | 40000 | 1150 | 7000 | 412 | Example |
| A3 | 75000 | 1150 | 7000 | 705 | Comparative Example |
| A4 | 26244 | 1150 | 10000 | 507 | Comparative Example |
| A5 | 26244 | 1200 | 7000 | 1072 | Comparative Example |

It can be seen from Samples A1 to A3 that, by adjusting the casting cross-sectional area of each of Samples No. A1 to A3 to be 40000 $cm^2$ or less, the total decarburized depth in surface layer of the rolled steel bar can be reduced to be 500 μm or less even in a case where heating conditions during steel bar rolling are a high temperature and a long time (1150° C.×7000 seconds), in which decarburization is promoted. Further, it can be seen from the results of Sample No. A4 that, even in a case where the heating temperature at the start of steel bar rolling is set as 1150° C., when a holding time is 10000 seconds which is longer than 7000 seconds, the total decarburized depth in surface layer of the rolled steel bar is excessively deep. In addition, it can be seen from the result of Sample No. A5 that, in a case where the heating temperature during the steel bar rolling is set as 1200° C., the total decarburized depth in surface layer of the rolled steel bar is excessively deep. Therefore, supposedly, it is preferable that the holding temperature at the start of steel bar rolling is 1000° C. to 1150° C. and the holding time is 7000 seconds or shorter.

Example 2

Steels (Nos. B to AH) having chemical compositions shown in Table 3 were made and then were continuously cast. As a result, cast pieces having a cross-sectional area of 40000 $cm^2$ were obtained. The remainder of Table 3 includes Fe and impurities. These cast pieces were hot-rolled without blooming to produce rolled steel bars having a diameter of 40 mm. As shown in Table 4, the cast pieces were hot-rolled at a heating temperature of 1150° C. to 1200° C. for a holding time of 2000 seconds to 7000 seconds. After the hot rolling, the rolled steel bars were air-cooled.

TABLE 3

| Steel | Component (mass %) | | | | | | | | | | | | | | | | |
|---|---|---|---|---|---|---|---|---|---|---|---|---|---|---|---|---|---|
| No. | C | Si | Mn | P | S | V | Ti | Ca | Zr | Te | Cr | Al | N | Mn/S | K1 | K2 | K3 |
| B | 0.46 | 1.03 | 0.64 | 0.006 | 0.046 | 0.14 | | | | | 0.04 | 0.008 | 0.0040 | 13.9 | 0.95 | 85 | 17.7 |
| C | 0.55 | 1.18 | 0.61 | 0.021 | 0.050 | 0.09 | | | | | 0.04 | 0.007 | 0.0024 | 12.2 | 0.98 | 95 | 23.4 |
| D | 0.59 | 1.45 | 0.52 | 0.044 | 0.020 | 0.09 | | | | | 0.10 | 0.005 | 0.0037 | 26.0 | 1.04 | 86 | 17.0 |
| E | 0.50 | 1.01 | 0.60 | 0.026 | 0.044 | 0.16 | | 0.0006 | | | 0.04 | 0.004 | 0.0042 | 13.6 | 1.01 | 80 | 24.1 |
| F | 0.65 | 1.11 | 0.44 | 0.030 | 0.051 | 0.09 | | 0.0009 | | 0.0013 | 0.07 | 0.007 | 0.0024 | 8.6 | 1.04 | 79 | 40.2 |
| G | 0.51 | 1.06 | 0.97 | 0.020 | 0.095 | 0.08 | | | 0.0015 | | 0.04 | 0.008 | 0.0058 | 10.2 | 0.98 | 54 | 23.2 |
| H | 0.48 | 1.18 | 0.53 | 0.031 | 0.054 | 0.19 | 0.035 | 0.0012 | | 0.0021 | 0.05 | 0.005 | 0.0055 | 9.8 | 1.05 | 42 | 13.8 |
| I | 0.53 | 1.12 | 0.55 | 0.022 | 0.038 | 0.13 | 0.018 | 0.0010 | | | 0.03 | 0.006 | 0.0047 | 14.5 | 1.00 | 70 | 23.3 |
| J | 0.49 | 1.28 | 0.54 | 0.043 | 0.039 | 0.12 | | | | | 0.06 | 0.005 | 0.0055 | 13.8 | 0.97 | 53 | 10.8 |
| K | 0.41 | 0.30 | 0.95 | 0.035 | 0.063 | 0.11 | | | | | 0.10 | 0.004 | 0.0059 | 15.1 | 0.81 | 99 | 43.0 |
| L | 0.52 | 1.14 | 0.45 | 0.014 | 0.095 | 0.13 | | | | | 0.05 | 0.007 | 0.0040 | 4.7 | 0.97 | 21 | 21.1 |
| M | 0.57 | 1.21 | 0.30 | 0.016 | 0.055 | 0.11 | | | | | 0.07 | 0.008 | 0.0051 | 5.5 | 0.97 | 22 | 24.9 |
| N | 0.60 | 1.62 | 0.44 | 0.008 | 0.046 | 0.08 | | | | | 0.04 | 0.005 | 0.0055 | 9.6 | 1.04 | 27 | 10.9 |
| O | 0.45 | 1.01 | 1.40 | 0.011 | 0.055 | 0.08 | | | | | 0.05 | 0.005 | 0.0051 | 25.5 | 1.00 | 143 | 17.2 |
| P | 0.47 | 1.46 | 0.66 | 0.040 | 0.044 | 0.10 | | | | | 0.09 | 0.005 | 0.0049 | 15.0 | 0.96 | 64 | 0.2 |
| Q | 0.48 | 1.20 | 0.44 | 0.016 | 0.039 | 0.08 | | | | | 0.10 | 0.006 | 0.0030 | 11.3 | 0.86 | 78 | 13.0 |
| R | 0.50 | 1.46 | 0.47 | 0.010 | 0.050 | 0.11 | | | 0.0010 | | 0.03 | 0.007 | 0.0058 | 9.4 | 0.97 | 27 | 4.3 |
| S | 0.54 | 1.26 | 0.90 | 0.010 | 0.135 | 0.08 | | | | 0.0010 | 0.05 | 0.004 | 0.0040 | 6.7 | 1.02 | 31 | 18.5 |
| T | 0.70 | 1.02 | 0.50 | 0.033 | 0.043 | 0.08 | | 0.0008 | | | 0.05 | 0.004 | 0.0046 | 11.6 | 1.07 | 65 | 51.0 |
| U | 0.55 | 1.11 | 0.62 | 0.046 | 0.045 | 0.05 | | | | | 0.10 | 0.005 | 0.0050 | 13.8 | 0.91 | 68 | 26.5 |
| V | 0.46 | 1.02 | 0.53 | 0.007 | 0.044 | 0.21 | | | | | 0.09 | 0.003 | 0.0023 | 12.0 | 1.04 | 98 | 18.1 |
| W | 0.50 | 1.48 | 0.65 | 0.048 | 0.065 | 0.09 | | | | | 0.09 | 0.002 | 0.0066 | 10.0 | 0.98 | 22 | 3.4 |
| X | 0.54 | 1.44 | 0.65 | 0.012 | 0.050 | 0.08 | | | | | 0.03 | 0.007 | 0.0039 | 13.0 | 1.00 | 72 | 10.6 |
| Y | 0.50 | 1.22 | 0.42 | 0.032 | 0.057 | 0.13 | | | | | 0.09 | 0.008 | 0.0045 | 7.4 | 0.96 | 40 | 14.8 |
| Z | 0.53 | 1.21 | 0.50 | 0.012 | 0.050 | 0.15 | | | | | 0.08 | 0.004 | 0.0060 | 10.0 | 1.03 | 35 | 19.4 |
| AA | 0.44 | 1.12 | 0.44 | 0.025 | 0.034 | 0.19 | | 0.0020 | | 0.0011 | 0.05 | 0.006 | 0.0045 | 12.9 | 0.98 | 64 | 11.0 |
| AB | 0.58 | 0.99 | 0.52 | 0.035 | 0.056 | 0.09 | 0.031 | 0.0009 | | | 0.06 | 0.007 | 0.0053 | 9.3 | 0.96 | 48 | 35.9 |
| AC | 0.55 | 1.11 | 0.39 | 0.031 | 0.044 | 0.11 | | 0.0018 | 0.0010 | | 0.08 | 0.005 | 0.0039 | 8.9 | 0.96 | 59 | 26.5 |
| AD | 0.66 | 1.10 | 0.53 | 0.043 | 0.064 | 0.08 | | | | | 0.08 | 0.004 | 0.0039 | 8.3 | 1.05 | 58 | 42.0 |
| AE | 0.60 | 1.21 | 0.82 | 0.032 | 0.068 | 0.06 | 0.023 | | | | 0.04 | 0.007 | 0.0052 | 12.1 | 1.03 | 64 | 29.0 |
| AF | 0.53 | 1.15 | 0.67 | 0.030 | 0.058 | 0.09 | | | | | 0.06 | 0.003 | 0.0069 | 11.6 | 0.97 | 36 | 22.0 |

TABLE 3-continued

| Steel | Component (mass %) | | | | | | | | | | | | | | | | |
|---|---|---|---|---|---|---|---|---|---|---|---|---|---|---|---|---|---|
| No. | C | Si | Mn | P | S | V | Ti | Ca | Zr | Te | Cr | Al | N | Mn/S | K1 | K2 | K3 |
| AG | 0.48 | 1.22 | 0.61 | 0.021 | 0.042 | 0.12 | | | | | 0.15 | 0.008 | 0.0041 | 14.5 | 0.96 | 78 | 12.1 |
| AH | 0.62 | 1.09 | 0.64 | 0.022 | 0.048 | 0.11 | | | | | 0.08 | 0.007 | 0.0048 | 13.3 | 1.07 | 71 | 37.0 |

Underlined values represents that the values are out of the range of the present invention.

The total decarburized depths in surface layer of the rolled steel bars were obtained using the above-described method. The results are shown in Table 4.

Next, each of the rolled steel bars was heated to 1220° C. by high-frequency heating, was held at 1220° C. for 300 seconds, and immediately was pressed in a diameter direction to be forged into a flat sheet having a thickness of 10 mm. By cutting a side surface of the forged flat sheet, a test piece which has a parallel body having a cross-sectional width of 15 mm, a thickness of 10 mm (thickness as forged), and a length of 20 mm was obtained and provided for a tension compression fatigue test under completely reversed tension and compression and a tensile test. The tension compression fatigue test was performed according to JIS Z 2273, in which a maximum load stress representing a lifetime of $10^7$ or more was set as a fatigue limit. The tensile test was performed according to JIS Z 2241 at room temperature at a rate of 20 mm/min.

The forged surface of the parallel body was as forged without working. However, for reference, regarding Steels Nos. B and C, test pieces from which a decarburized layer was removed by grinding the surface into a depth of 500 μm after hot forging were provided (Test Nos. 2 and 3). In addition, all the corners of the cut portions of the test pieces were chamfered with a radius of 2 mm.

Tables 4 and 5 show the total decarburized depth in surface layer of the rolled steel bars before hot forging, the microstructures of the forged flat sheets after hot forging, the 0.2% proof stresses, the tensile strengths, the yield ratios (0.2% proof stress/tensile strength), and the fatigue limit ratios (fatigue limit/tensile strength) at $10^7$ times obtained by the tension compression test.

TABLE 4

| | | | | Rolled Steel Bar Total | Forged Flat Sheet | | | | | |
|---|---|---|---|---|---|---|---|---|---|---|
| Test No. | Steel No. | Heating Temperature ° C. | Holding Time sec | Decarburized Depth in Surface Layer μm | 0.2% Proof Stress MPa | Tensile Strength MPa | Yield Ratio | Fatigue Limit Ratio | Microstructure*1 | Note |
| 2 | B | 1150 | 7000 | 0 (After Grinding) | 677 | 940 | 0.72 | 0.50 | FP | Reference |
| 3 | C | 1150 | 7000 | 0 (After Grinding) | 639 | 969 | 0.66 | 0.49 | FP | Example |
| 4 | B | 1150 | 7000 | 369 | 638 | 911 | 0.70 | 0.48 | FP | Example |
| 5 | C | 1150 | 7000 | 423 | 592 | 925 | 0.64 | 0.47 | FP | |
| 6 | D | 1150 | 7000 | 485 | 618 | 951 | 0.65 | 0.46 | FP | |
| 7 | E | 1150 | 7000 | 378 | 622 | 929 | 0.67 | 0.47 | FP | |
| 8 | F | 1150 | 7000 | 225 | 619 | 953 | 0.65 | 0.46 | FP | |
| 9 | G | 1150 | 7000 | 280 | 626 | 920 | 0.68 | 0.48 | FP | |
| 10 | H | 1150 | 7000 | 394 | 682 | 1023 | 0.67 | 0.50 | FP | |
| 11 | I | 1150 | 7000 | 454 | 641 | 961 | 0.67 | 0.47 | FP | |
| 12 | B | 1200 | 2000 | 1022 | 562 | 865 | 0.65 | 0.45 | FP | Comparative |
| 13 | C | 1200 | 2000 | 1141 | 522 | 870 | 0.60 | 0.42 | FP | Example |
| 14 | D | 1200 | 2000 | 869 | 550 | 901 | 0.61 | 0.43 | FP | |
| 15 | E | 1200 | 2000 | 938 | 559 | 888 | 0.63 | 0.42 | FP | |
| 16 | F | 1200 | 2000 | 722 | 565 | 912 | 0.62 | 0.44 | FP | |
| 17 | G | 1200 | 2000 | 680 | 574 | 883 | 0.65 | 0.45 | FP | |
| 18 | H | 1200 | 2000 | 871 | 531 | 845 | 0.63 | 0.42 | FP | |
| 19 | I | 1200 | 2000 | 740 | 524 | 894 | 0.59 | 0.43 | FP | |
| 20 | J | 1150 | 7000 | 496 | 602 | 912 | 0.66 | 0.46 | FP | Example |

*1FP: Ferrite and pearlite structures

Test Nos. 2 and 3 are reference examples in which the decarburized layer was removed by grinding after hot forging.

TABLE 5

| | | | | Rolled Steel Bar Total | Forged Flat Sheet | | | | | |
|---|---|---|---|---|---|---|---|---|---|---|
| Test No. | Steel No. | Heating Temperature ° C. | Holding Time sec | Decarburized Depth in Surface Layer μm | 0.2% Proof Stress MPa | Tensile Strength MPa | Yield Ratio | Fatigue Limit Ratio | Microstructure*2 | Note |
| 21 | K | 1150 | 7000 | 355 | 548 | 794 | 0.69 | 0.44 | FP | Comparative |
| 22 | L | 1150 | 7000 | * | * | * | * | * | * | Example |
| 23 | M | 1150 | 7000 | * | * | * | * | * | * | |
| 24 | N | 1150 | 7000 | * | * | * | * | * | * | |
| 25 | O | 1150 | 7000 | 412 | 560 | 948 | 0.59 | 0.45 | FP + B | |

TABLE 5-continued

| Test No. | Steel No. | Heating Temperature ° C. | Holding Time sec | Rolled Steel Bar Total Decarburized Depth in Surface Layer μm | Forged Flat Sheet 0.2% Proof Stress MPa | Tensile Strength MPa | Yield Ratio | Fatigue Limit Ratio | Microstructure*2 Note |
|---|---|---|---|---|---|---|---|---|---|
| 26 | P | 1150 | 7000 | 767 | 559 | 860 | 0.63 | 0.43 | FP |
| 27 | Q | 1150 | 7000 | 255 | 558 | 821 | 0.68 | 0.45 | FP |
| 28 | R | 1150 | 7000 | * | * | * | * | * | * |
| 29 | S | 1150 | 7000 | * | * | * | * | * | * |
| 30 | T | 1150 | 7000 | 487 | 568 | 980 | 0.58 | 0.44 | FP |
| 31 | U | 1150 | 7000 | 455 | 545 | 879 | 0.62 | 0.44 | FP |
| 32 | V | 1150 | 7000 | 402 | 553 | 921 | 0.60 | 0.50 | FP + B |
| 33 | W | 1150 | 7000 | * | * | * | * | * | * |
| 34 | X | 1150 | 7000 | 528 | 543 | 905 | 0.60 | 0.43 | FP |
| 35 | Y | 1150 | 7000 | * | * | * | * | * | * |
| 36 | Z | 1150 | 7000 | * | * | * | * | * | * |
| 37 | AA | 1150 | 7000 | 253 | 541 | 864 | 0.63 | 0.48 | FP |
| 38 | AB | 1150 | 7000 | 398 | 537 | 923 | 0.58 | 0.45 | FP |
| 39 | AC | 1150 | 7000 | * | * | * | * | * | * |
| 40 | AD | 1150 | 7000 | 474 | 564 | 1078 | 0.52 | 0.41 | FP |
| 41 | AE | 1150 | 7000 | 318 | 523 | 937 | 0.56 | 0.43 | FP |
| 42 | AF | 1150 | 7000 | 350 | 560 | 894 | 0.63 | 0.43 | FP |
| 43 | AG | 1150 | 7000 | 346 | 537 | 957 | 0.56 | 0.47 | FP + B |
| 44 | AH | 1150 | 7000 | 416 | 551 | 1097 | 0.50 | 0.45 | FP + B |

*2FP: Ferrite and pearlite structures, B: bainite structure

* represents that the evaluation was not able to be performed.

Test Nos. 4 to 11 and 20 of Table 4 are Examples according to the present invention. All the total decarburized depth in surface layer of the rolled steel bars were 500 μm or less. In addition, in the forged flat sheets obtained by forging the rolled steel bars, the tensile strengths were 911 MPa or higher, the 0.2% proof stresses were 592 MPa or higher, and the fatigue limit ratios (fatigue limit/tensile strength) obtained by the tension compression fatigue test were 0.46 or higher. In addition, from a comparison between Test Nos. 2 and 3 in which the decarburized layer was removed by grinding after hot forging and Test Nos. 4 and 5, it can be seen that, in a case where the decarburized depth in the rolled steel bar is 500 μm or less, a decrease in the fatigue limit ratio is 0.02 or less.

Test Nos. 12 to 19 of Table 4 are Comparative Examples in which the decarburized depth of the rolled steel bar was more than 500 μm. Each of these examples does not satisfy at least one of tensile strength: 900 MPa or higher, 0.2% proof stress: 570 MPa or higher, and fatigue limit ratio: 0.45 or more.

Test Nos. 21 to 44 of Table 5 are Comparative Examples of Steels Nos. K to AH in which the any of the steel component (chemical composition), Mn/S, K1, K2, or K3 is out of the range of the present invention.

In Test Nos. 22, 23, 24, 28, 29, 33, 35, and 36 using Steel Nos. L, M, N, R, S, W, Y, and Z in which M/S was lower than 8.0 or the K2 value was lower than 35%, cracks or large defects occur during steel bar forging, and thus the evaluation was not performed after hot forging. Therefore, the evaluation items of Table 5 are shown as "*".

In Test No. 21 (Steel No. K), the C content, the Si content, and the K1 value were low, and the tensile strength and the 0.2% proof stress did not reach 900 MPa and 570 MPa, which were desired values, respectively.

In Test No. 25 (Steel No. O), not only ferrite and pearlite but also bainite were present together in the microstructure of the forged product. In Test No. 25, the 0.2% proof stress did not reach 570 MPa that was a desired value. The reason for this is presumed to be that, since the structure had a large amount of Mn, not only ferrite and pearlite (FP) structures but also the bainite (B) structure were present together.

In Test No. 26 (Steel No. P) in which the K3 value was low, during the hot rolling, the heating temperature was 1150° C. and the holding time was 7000 seconds. The decarburized depth of surface layer of the rolled steel bar was more than 500 μm, and the tensile strength, the 0.2% proof stress, and the fatigue limit ratio were low due to the decarburization.

In Test No. 27 (Steel No. Q) in which the K1 value was low, the tensile strength and the 0.2% proof stress were low.

In Test No. 30 (Steel No. T), since the C content was high, the tensile strength was high, but the 0.2% proof stress and the fatigue limit ratio were low.

In Test No. 31 (Steel No. U), the V content was low, and K1 was low. Therefore, the tensile strength and the 0.2% proof stress were lower than 900 MPa and 570 MPa, which were desired values, respectively.

In Test No. 32 (Steel No. V), the V content was high. Therefore, the tensile strength and the fatigue limit ratio were satisfactory, but the 0.2% proof stress was low due to the presence of the bainite structure.

In Test No. 23 (Steel No. M), Mn/S was low. Therefore, cracks and defects occurred during forging. In Steel No. J, Mn/S was low. Therefore, cracks and defects occurred during forging.

In Test No. 24 (Steel No. N), the Si content was high, and K2 was low. Therefore, cracks and defects occurred during forging.

In Test No. 34 (Steel No. X), the amounts of the respective elements were within the range of the present invention, but K3 was lower than 10.7%. Therefore, the total decarburized depth in surface layer was large, and the 0.2% proof stress was low.

In Test No. 28 (Steel No. R), K2 was low. Therefore, cracks and defects occurred during forging.

In Test No. 29 (Steel No. 5), Mn/S was low. Therefore, cracks and defects occurred during forging.

In Test No. 35 (Steel No. Y), the steel component was in the desired range and the values of K1, K2, and K3 were also within the range of the present invention; however, the value of Mn/S was lower than 8.0. Therefore, cracks and large defects occurred during steel bar forging.

In Test No. 37 (Steel No. AA), K1 was satisfied, but the C content was low. Therefore, the tensile strength and the 0.2% proof stress were lower than 900 MPa and 570 MPa, which were desired values, respectively.

In Test No. 38 (Steel No. AB), K1 was satisfied, but the Si content was low. Therefore the 0.2% proof stress was low.

In Test No. 39 (Steel No. AC), the Mn/S value and the K2 value were satisfied, but the Mn content was low. Therefore, cracks and large defects occurred during forging.

In Test No. 40 (Steel No. AD), K1 was satisfied, but the C content was high. Therefore, the tensile strength was high, but the 0.2% proof stress and the fatigue limit ratio were low.

In Test No. 41 (Steel No. AE), K1 was satisfied, but the V content was low. Therefore the 0.2% proof stress and the fatigue limit ratio were low.

In Test No. 42 (Steel No. AF), the N content was high. Therefore, the amount of V nitride increased, the contribution of V to precipitation strengthening was small, and the tensile strength, the 0.2% proof stress, and the fatigue limit ratio were low.

In Test No. 43 (Steel No. AG), the Cr content was high. Therefore, the tensile strength and the fatigue limit ratio were high, but the 0.2% proof stress was low due to the presence of the bainite structure.

In Test No. 44 (Steel No. AH), K1 was high. Therefore, the 0.2% proof stress was low due to the presence of the bainite structure.

INDUSTRIAL APPLICABILITY

In the surface of the rolled steel bar for machine structural use according to the present invention in which the Cr content and the Al content are limited and which includes a large amount of Si to reduce the costs, the formation of a deep decarburized layer can be prevented. A mechanical structural member which is produced by hot-forging the rolled steel bar has excellent fatigue resistance and thus remarkably contributes to the industry. In addition, under the production conditions according to the aspects of the present invention, a blooming step can be removed from the production steps of the rolled steel bar. Therefore, the production costs can be reduced, and the contribution to the industry is extremely significant.

The invention claimed is:

1. A rolled steel bar for machine structural use having a chemical composition comprising, by mass %, C: 0.45% to 0.65%,
Si: higher than 1.00% to 1.50%,
Mn: higher than 0.40% to 1.00%,
P: 0.005% to 0.050%,
S: 0.020% to 0.100%,
V: 0.08% to 0.20%,
Ti: 0% to 0.050%;
Ca: 0% to 0.0030%,
Zr: 0% to 0.0030%,
Te: 0% to 0.0030%, and
a remainder including Fe and impurities,
wherein the impurities include:
Cr: 0.10% or lower,
Al: lower than 0.01%, and
N: 0:0060% or lower,
K1 obtained from the following Expression 1 is 0.95 to 1.05,
K2 obtained frorn the following Expression 2 is more than 35,
K3 obtained from the following Expression 3 is 10.7 or more,
a Mn content and a S content satisfy the following Expression 4,
a total decarburized depth in a surface layer is 500 μm or less, $$K1=C+Si/7+Mn/5+1.54\times V \quad \text{(Expression 1)},$$

$$K2=139-28.6\times Si+105\times Mn-833\times S-13420\times N \quad \text{(Expression 2)},$$

$$K3=137\times C-44.0\times Si \quad \text{(Expression 3)},$$

$$Mn/S\geq 8.0 \quad \text{, and(Expression 4)}$$

C, Si, Mn V, S, and N in the Expressions 1 to 4 represent the amounts of the respective elements in mass %.

2. The rolled steel bar for machine structural use according to claim 1, wherein the chemical composition further comprising, by mass %, one or more selected from the group consisting of
Ti: 0.010% to 0.050%,
Ca: 0.0005% to 0.0030%,
Zr: 0.0005% to 0.0030%, and
Te: 0.0005% to 0.0030%.

3. A method of producing the rolled steel bar for machine structural use having the chemical composition according to claim 2, the method comprising:

making molten steel having said chemical composition;
continuously casting the molten steel to obtain a cast piece having a cross-sectional area of 40000 $cm^2$ or less; and
subsequently to the continuous casting, heating the cast piece to a temperature range of 1000° C. to 1150° C. and holding the cast piece in the temperature range for 7000 seconds or shorter and performing a steel bar rolling.

4. A method of producing the rolled steel bar for machine structural use having the chemical composition according to claim 1, the method comprising:

making molten steel having said chemical composition;
continuously casting the molten steel to obtain a cast piece having a cross-sectional area of 40000 $cm^2$ or less; and
subsequently to the continuous casting, heating the cast piece to a temperature range of 1000° C. to 1150° C. and holding the cast piece in the temperature range for 7000 seconds or shorter and performing a steel bar rolling.

* * * * *